US006460460B1

(12) United States Patent
Jasper, Jr. et al.

(10) Patent No.: US 6,460,460 B1
(45) Date of Patent: Oct. 8, 2002

(54) LASER-ACTIVATED GRENADE WITH AGILE TARGET EFFECTS

(75) Inventors: Louis J. Jasper, Jr., Fulton, MD (US); Alba Lalitha Ramaswamy, Washington, DC (US)

(73) Assignee: University of Maryland, College Park, MD (US)

( * ) Notice: Subject to any disclaimer, the term of this patent is extended or adjusted under 35 U.S.C. 154(b) by 0 days.

(21) Appl. No.: 09/606,047

(22) Filed: Jun. 29, 2000

(51) Int. Cl.[7] ..... F42C 19/00
(52) U.S. Cl. ..... 102/201; 102/213; 280/728
(58) Field of Search ..... 102/201, 213; 280/728

(56) References Cited

U.S. PATENT DOCUMENTS 4,353,301 A * 10/1982 Jacobsen
4,436,034 A * 3/1984 Jacobsen et al.
4,884,506 A * 12/1989 Guerreri
5,052,300 A * 10/1991 Josse
5,148,748 A * 9/1992 Yarrington
5,159,149 A * 10/1992 Marsden
5,196,644 A * 3/1993 Knight et al.
H1214 H * 8/1993 Liva et al.
5,322,019 A * 6/1994 Hyland
5,406,889 A * 4/1995 Letendre et al.
5,413,045 A * 5/1995 Miszewski
5,460,407 A * 10/1995 Stuckle
5,526,749 A * 6/1996 Teetzel
5,660,413 A * 8/1997 Bergerson et al.
5,756,924 A * 5/1998 Early
5,841,059 A * 11/1998 Laurend et al.
5,874,690 A * 2/1999 Brunn
5,914,458 A * 6/1999 Folsom et al.
5,983,801 A * 11/1999 Brunn
6,047,643 A * 4/2000 Benner et al.
6,161,481 A * 12/2000 Shirk et al.
6,199,483 B1 * 3/2001 Barbiche
6,227,144 B1 * 5/2001 Wu et al.

* cited by examiner

*Primary Examiner*—Charles T. Jordan
*Assistant Examiner*—Troy Chambers
(74) *Attorney, Agent, or Firm*—Rosenberg, Klein & Lee

(57) ABSTRACT

A laser activated grenade is provided which includes a controllable laser source activated at specific times to generate radiation pulses. An energetic material within the grenade is ignited upon delivery of the generated radiation pulses. A propellant charge material triggers a propellant explosive train when the energetic material ignites. The grenade further includes load materials which are selectively activated once the propellant explosive train has been launched. The laser source may be located remotely from the grenade in order that the generated radiation pulses travel to the grenade through a fiber optic cable. Alternatively, the laser source may be embedded in the grenade and activated by a microwave/RF coded signal received from a remote signal transmitter. The grenade may carry a number of load materials so that each load material is activated either alone to produce a desired target effect, or in combination to produce a cumulative target effect such as light, sound, malodorous, as well as other incapacitating phenomena. In lethal implementation, the grenade may include shrapnel as a load which explodes when detonated at the target.

22 Claims, 7 Drawing Sheets

LASER-ACTIVATED GRENADE WITH AGILE TARGET EFFECTS

FIELD OF THE INVENTION

The present invention relates to munitions; and more particularly to non-lethal and lethal grenades with prompt, quick or agile target effects for crowd and riot control.

The present invention further relates to fragmenting and non-fragmenting grenades which are remotely activated by means of a laser source which generates radiation pulses at predetermined times for triggering the grenade for creating target effects (pyrotechnic, malodorous, dye, light, or sound).

Further, the present invention relates to a laser activated grenade with actuation controlled by a laser source positioned remotely from the grenade and possibly connected to the grenade through a fiber optic cable.

Furthermore the present invention relates to a laser activated grenade with a laser source embedded in a grenade canister where the laser source is actuated through coded control signals such as microwave/RF signals transmitted from a remote transmitter.

Additionally, the present invention relates to a laser activated grenade which carries a plurality of load materials with each capable of producing a specific or cumulative target effect upon selective activation of respective load materials maintained within the grenade.

BACKGROUND OF THE INVENTION

The reduction of hazards associated with the production, transportation, storage, and handling of munitions has been a priority goal for both military and civilian munitions manufacturers. The consequences of accidents caused by munitions are serious and may result in loss of life, equipment, and may cause environmental damage. During battlefield conflicts, accidents involving munitions may benefit the enemy.

Munitions technologies have been developed to reduce the risks from deliberate or accidental threats which include insensitive munitions (IM) directed to munitions that have lower vulnerability to accidental triggering. As a major consequence of developing insensitive munitions, energetic materials have been developed to serve as a primary charge. Typically, percussion mechanisms or a friction process are used to ignite pyrotechnic systems of insensitive munitions. Low voltage electrical igniters are also used in the insensitive munitions, however, they are susceptible to stray electrical discharges and spurious radio frequency (RF) signals.

In 1997, the Office of Secretary of Defense (of the United States) established a Joint Services Non-Lethal (NL) program with the U.S. Marine Corps as Executive Agent. NL weapons are explicitly designed and primarily employed in order to incapacitate personal or materiel while minimizing fatalities and permanent injury to persons as well as reducing undesired damage to property and the environment. In military operations other than war and in operations on urban terrain, NL technologies are preferred for certain scenarios such as riot or crowd control, disablement or pre-emptive weapons of mass destruction, protection of non-combatants in volatile situations, and in the establishment of exclusion zones.

One problem associated with typical grenades (lethal and non-lethal) is that upon being actuated and thrown at the target, the activated grenade may be thrown back to Law Enforcement or military personnel thus causing injuries or loss of life.

Accordingly, a safer grenade, both fragmenting and non-fragmenting fulfilling the military needs for insensitive munitions, for in controlling and dispersing crowds, disorienting personnel in a variety of riot applications, and with minimal collateral damage is needed in both military and Law Enforcement scenarios.

SUMMARY OF THE INVENTION

It is therefore an object of the present invention to provide a controllable lethal or non-lethal grenade with agile target effects applicable to crowd and riot control for close-in range (less than 50 meters) application.

It is another object of the present invention to provide a laser activated grenade which is remotely activated to produce cumulative target effects with the grenade carrying multiple loads (each responsible for a distinctive target effect) selectively actuated by radiation pulses generated at the laser source.

It is still a further object of the present invention to provide a laser activated grenade where the laser source is positioned remotely from the grenade and is connected to the grenade through a fiber optic cable (single or multiple) via which the radiation pulses generated at the laser source are delivered to the grenade when needed.

It is still another object of the present invention to provide a laser activated grenade in which the laser source is embedded into the grenade and is actuated by coded control microwave/RF signals propagating to the laser source from a remotely located coded signal transmitter.

It is a further object of the present invention to provide a laser activated grenade using infrared (IR) or ultraviolet (UV) radiation as an ignition source for energetic material. In this manner, highly reliable RF/electrical static discharge (ESD)/electromagnetic pulse (EMP) immune igniters are created which use miniature lasers, high power laser diodes, or optically pumped laser rods in combination with insensitive munitions (IM). Use of the technologies as herein described allows the user to use environmentally safe insensitive munitions which enjoy reliable tunability, cumulative target effects, multiple loads, improved performance and compactness.

In accordance with the present invention, a laser activated grenade includes:

- a controllable laser source activated at intended times to generate radiation pulses,
- at least one energetic material,
- a coupling system operatively connecting the laser source to the energetic material for delivery of the radiation pulses to the energetic material in order that the radiation pulses ignite the energetic material upon being delivered thereto,
- at least one propellant charge material positioned in operational contact with the energetic material and triggering a propellant explosive train upon ignition of the energetic material,
- at least one load material disposed in operational contact with the propellant charge material to produce a predetermined target effect upon launching of the propellant explosive train.

It is to be understood that the radiation pulses may be infrared, ultraviolet, or in the visible spectrum.

The grenade itself includes a canister, at least one primary section receiving the energetic material within the canister, at least one propellant section positioned in direct contact with the primary section and receiving the propellant charge material therein, and at least one load section positioned in proximity to the propellant section and receiving load material therein.

There are several embodiments of the laser activated grenade of the present invention which include:

- the grenade where the laser source is positioned remotely from the grenade in order that the output of the laser source is coupled to the primary section (energetic material) through a fiber optic cable, or
- the grenade having the laser source embedded in the canister, in order that the laser is activated by a coded signal sent from a remote transmitter.

In the arrangement where a fiber optic cable is used to transmit radiation pulses from the laser source to the energetic material, the canister further has a cable storage compartment which receives the cable for release thereof to some predetermined length.

It is essential that the grenade may carry a plurality of load materials each producing a predetermined distinctive target effect so that each load material can be selectively "activated" by the laser source to produce either a single target effect or a cumulative target effect subject to the particular situation encountered.

In lethal implementation the laser activated grenade of the present invention has a primary section surrounded by the propellant section which in turn is surrounded by a load section which includes a lethal fragmenting load material.

In the implementation where the laser source is activated by a remote coded signal the canister is made of a material transparent having low loss to the spectrum of the coded control signal and in particular low loss with respect to microwave/RF radiation or the canister has a receiving antenna that is integral with the canister housing and connected to a miniaturized receiver.

The fiber optic cable may include a plurality of cables separately controlled to transmit radiation pulses to the intended energetic materials within the grenade in order to selectively target an intended target effect.

The canister of the grenade is preferably positioned within a polyurethane shell of substantially spherical/oval geometry. The shell has a notch formed therein extending around a periphery thereof so that the fiber optic cable is wound around the shell and extends along as well as within the notch.

The radiation source may be a laser rod, a laser diode array sub-system, or a miniature laser.

With respect to another aspect of the present invention, such directs itself to a method of controlling a grenade which includes the steps of:

- providing a controllable laser source capable of generating radiation pulses upon activation,
- providing a grenade including at least one energetic material, at least one propellant charge material, and at least one load material,
- coupling an output of the laser source with the at least one energetic material,
- delivering the grenade to the intended target,
- activating the laser source, whereby the radiation pulses generated by the activated laser source are delivered from the laser source to the energetic material causing ignition of same, and further causing launching of a propellant explosive train from at least one propellant charge material resulting in producing a predetermined target effect by the load material.

These and other novel features and advantages of this invention will be fully understood from the following detailed description of the accompanying drawings.

DESCRIPTION OF THE PREFERRED EMBODIMENTS

The munitions of the present invention is a laser activated grenade which may be manufactured in a non-lethal or lethal implementation, having an extended effective range devoid of a primary fuse, and minimal safety and environmental concerns.

In a non-lethal embodiment, the grenade is a non-fragmenting grenade (diversionary charge) which may have multiple combinations of loads. For example, the grenade may have intense light or sound displays alone or in combination with malodorous or incapacitating agents. In the lethal embodiment, the grenade may be a fragmentary grenade filled with shrapnel.

By remotely activating the grenade of the present invention at the target location, the controlling party (Law Enforcement Officers or military personnel) is protected from possible injuries since the zone of deployment of the grenade is remote from the user, and the live grenade cannot be thrown back to the user with any effect since it is activated at the target from the remote position.

Figure 1:
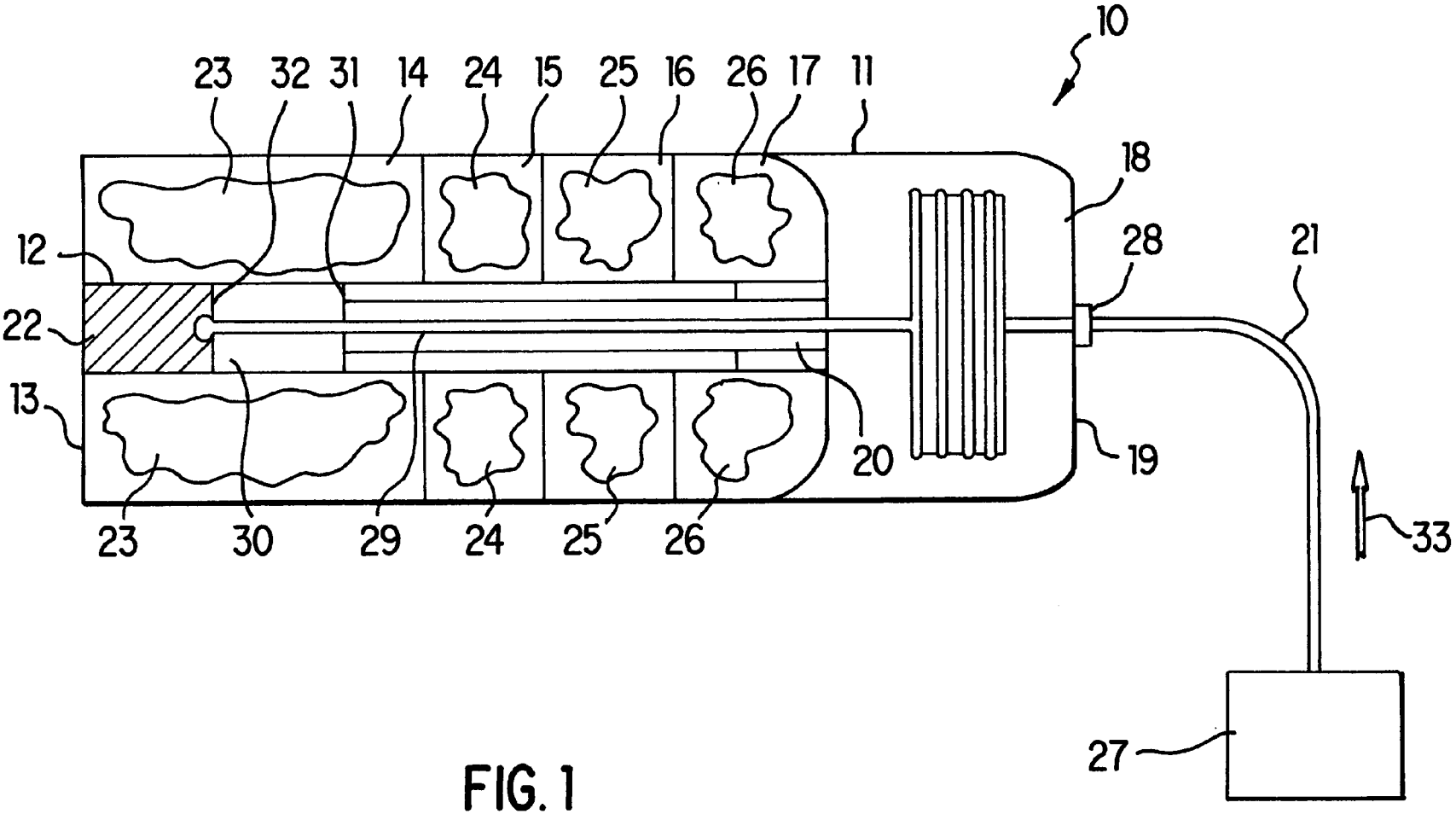
FIG. 1 is a schematic diagram of a non-fragmenting grenade with a single laser-input port.

Referring to FIG. 1, the grenade 10 of the present invention includes a canister 11 having a primary section 12 disposed at a proximal end 13 of the canister 11, a propellant section 14 positioned in contact with the primary section 12, a plurality of load sections 15, 16, 17, and a cable compartment 18 at the distal end 19 of the canister 11. A cable channel 20 extends between the cable compartment 18 and the primary section 12 and receives therein fiber optic cable 21 provided for the purposes described in detail in further paragraphs.

An energetic material 22, also referred herein as a primer, is received within the primary section 12. The preferred energetic material is one that is insensitive, i.e., having lower vulnerabilities, and is consistent with a load material (to be discussed in further paragraphs). For example, $B/Fe0_3$ with or without ZnO, crystalline nitramines used with thermoplastic elastomer binders, SR43, SR44, SR252, or G20 compositions are candidate materials which may be used in the grenade of the present invention.

The propellant section 14 receives a propellant charge material 23, such as a standard $HNO_3$ propellant, or Petn (pentaerythritoltranite) black powder (a mixture of potassium nitrate, sulfur, charcoal).

Each of the load sections 15–17 receives a specific load material 24, 25, 26, capable of producing a distinctive target effect which may be pyrotechnic flashes (flash powder which uses powder metals such as aluminum, zinc, magnesium with an oxidizer such as barium nitrate or ammonium perchlorate), sound charges (pyropechnic whisle which may include potassium perchlorate, potassium benzoate or potassium hyperchorate), malodorants or other load materials having an incapacitating effect. The load material may be also in the form of shrapnel, the type of which should be consistent with the lethal or non-lethal desired effects. The sound charges should generate a minimum of 165 DB on target, and have a frequency spectrum and sound duration which do not cause human ear damage while simultaneously being effective in disorientating an adversary. The flash charge generally places a minimum of one million candlepower on target having a time duration of several milliseconds so as not to damage the human eye while once again being effective in disorientating the adversary.

Chemical agents used as load materials for personnel immobilization may include tear gases such as, for example:

A. Riot Control Agent CS: Agent CS is orathochloraobenzalmalononitrile, a white-to-yellow crystalline powder prepared as the combustion product of orthochlorobenzaldehyde with malononitrile or the condensation product of orthochlorobenzaldehyde with cyanoacetamide and subsequent dehydration. It has a pungent pepper-like odor that is immediately detectable by the senses. It can be disseminated as smoke or mist from pyrotechnic devices and is normally nonpersistent. CS is stable in all climates. It may be put into gelatin capsules or dissolved in a liquid.

The physiological and physical properties of CS-type agents make their use particularly effective for immediate temporary incapacitation of unmasked personnel. CS produces immediate effects even in low concentration. The median effective incapacitating concentration which produces respiratory effects is 10 to 20 $mg/m^3$ but the concentration which produces eye effects is 1 to 5 $mg/m^3$. The onset of incapacitation is 20 to 60 seconds, and the duration of effects is 5 to 10 minutes after the affected individual is provided with fresh air. During this time affected individuals are incapable of effective concerted action. The physiological effects of low concentrations include extreme burning of the eyes accompanied by considerable flowing of tears, coughing, breathing difficulties, chest tightness, involuntary closing of the eyes, stinging sensation of moist skin, runny nose and dizziness or swimming of the head. Particle size, concentration and local weather conditions, rather than duration of exposure, determine the effectiveness of CS.

B. Riot Control Agent CR: Agent CR is dibenz (b.f.)-1:4-oxazepine, a yellow crystalline solid which is another highly irritant compound similar to CS in respect to both its effect and its safety. It differs from CS in that it is more potent as an irritant and, although only sparingly water soluble, it is chemically stable in organic solutions (ethylene or propylene glycol) and thus remains active for a much longer time. CR may be used as an aerosol with effects similar to those of CS, or it may be used in solution so that it can be directed with accuracy against small groups of rioters or even individuals. In solution, CR is found to be irritant at concentrations down to 0.0025% or even lower. Liquid contamination by CR affects eyes, skin, mouth and nasal cavity. Currently, CR is being used only in solution for dissemination in liquid dispersers and, as such, its effectiveness is primarily in the eyes.

Riot Control Agent CR solution consists of 0.1% CR dissolved in a solution of 80 parts of polypropylene glycol and 20 parts of water. This solution has been approved by The U.S. Army Surgeon General for use on personnel in riot situations.

Riot control agent CR is similar to riot control agent CS with respect to toxicity and physiological effects. CR differs from CS in that CR skin effects are more pronounced and longer lasting and may make the skin very sensitive for hours or even days when rubbed or washed. It is also more persistent in the environment and on clothing since it is not broken down by water as is CS. With CR, development of an allergy is less likely than for CS, but it does occur occasionally. Inhalation toxicity of CR is less than that of CS, and there is a moderate irritation of the lower respiratory tract with a resulting feeling of suffocation, coughing and chest pain. CR causes a burning sensation and tearing of the eyes and also irritation of the nose and throat. The respiratory effects disappear within a few minutes after the individual is removed to an agent-free atmosphere.

The load chemicals may also include the following agents:

Calmatives: Calmative agents are chemicals that leave those affected awake and mobile but without the will or ability to carry out criminal activity. These agents will be particularly useful in situations where negotiation with adversaries/perpetrators is desirable.

Immobilizers: Immobilizers are chemical compounds that produce incapacitation through immobilization, disorientation or unconsciousness. Among the classes of neuropharmacologic agents with potential as immobilizers are anesthetics, analgesics, sedatives and hypnotics.

Malodorous Agents: Malodorous Agents produce pungent odors that cause physical and possibly physiological discomforting reactions in individuals. The degree of persistency can be controlled by means of additives that regulate the rate of evaporation.

Effective malodorants and incapacitating agents are well-known to those skilled in the art. They include, for example, Butyl mercaptan (skunk), dithistreitol (rotten eggs). The chemicals used as load materials are chosen to be safe, effective, environmentally friendly, and produce the desired target effects over a desired time.

After delivery to the target, the grenade is activated by a user (for example, Law Enforcement Officer) by radiation pulses generated at a laser source 27 which is positioned remote from the grenade. As shown in FIG. 1, the radiation pulses are delivered from the laser source 27 over the fiber-optic cable 21 to the distal end 19 of the canister 11 which has a cable port 28 to pass the fiber-optic cable 21 therethrough. Approximately 100 feet of fiber-optic cable may be stored in the cable compartment 18 and is freely released therefrom through the cable port 28 as the grenade travels towards the target.

The end 29 of the fiber-optic cable 21 is positioned within the cable channel 20 and extends between the cable compartment 18 and the primary section 12. A laser port 30 is positioned between the end 31 of the cable channel 20 and the front surface 32 of the primary section 12. Thus, the end 29 of the fiber-optic cable 21 protrudes through the laser port 30 and is arranged in a predetermined relationship with the front surface 32 of the primary section 12 for purposes further described in following paragraphs. The laser source 27 may be a miniature laser, high power laser diode, or optically pumped laser rod. The preferred laser source for the grenade 10 of the present invention is a light compact IR source consistent with the required energy and power output which produces pulses having characteristics required to ignite the energetic material 22 chosen to generate the various displays (target effects).

The spectral properties of the radiation pulses that is used is the predominant factor in the ignition process of the energetic material 22. Infrared (IR), ultraviolet (UV), or visible radiation has been shown to ignite energetic materials. Therefore, the properties of the energetic material such as physical, chemical, thermal diffusivity, heat of reaction, radiation absorption coefficient, and efficiency of converting the absorbed radiation into heat must be consistent with the spectral properties of the radiation to produce the best performance and the safest grenade 10.

Upon actuating of the laser source 27, by turning the laser source "ON" as known to those skilled in the art, IR, UV, or visible radiation pulses are generated by the laser source 27 and transmitted to the grenade via the fiber-optic cable 21 (the direction of the energy flow is indicated by the arrow 33) and is delivered to the primary section 12 via the laser port 30.

The laser port 30 arranges the fiber-optic cable end 29 in a predetermined relationship to the front surface 32 of the primary section 12. The arrangement of the fiber-optic cable end 29 in relationship to the front surface 32 is important due to the fact that it determines the spot size of the radiation on the energetic material 22. A larger spot size may be obtained by positioning the fiber-optic cable end 29 away from the energetic material 22, or alternatively a diverging lens can be used to enlarge the spot size.

Multiple spots with different spot diameters may be formed by using a fiber-optic bundle, or by splitting the fiber-optic cable end 29 and varying the positions of the separate fibers in relationship to the energetic material 22. A smaller spot size may be made by positioning the fiber-optic cable end 29 directly on the front surface 32 of the energetic material 22 or a converging lens may be used to radiate the energetic material 22.

The energetic material 22 is ignited by the laser energy, and the ignition of the energetic material initiates the propelling charge explosive train and the burning process of the propellant charge material 23 in the propellant section 14. The burning propellant charge material 23 in turn actuates the load materials, such as pyrotechnic load in the light section 15 and/or sound section 16, and/or malodorous or dye marker in the section 17.

All the sub-systems of the grenade 10 are compact and lightweight. The grenade with a preferred weight of less than one pound and a preferred size of less than 4 inches in diameter is designed in order to facilitate throwing the grenade 10 to a distance greater than 100 feet. The grenade in fragmentary implementation is bulkier due to the weight of the shrapnel inside of the canister, which consequently reduces the effective range.

Figure 2:
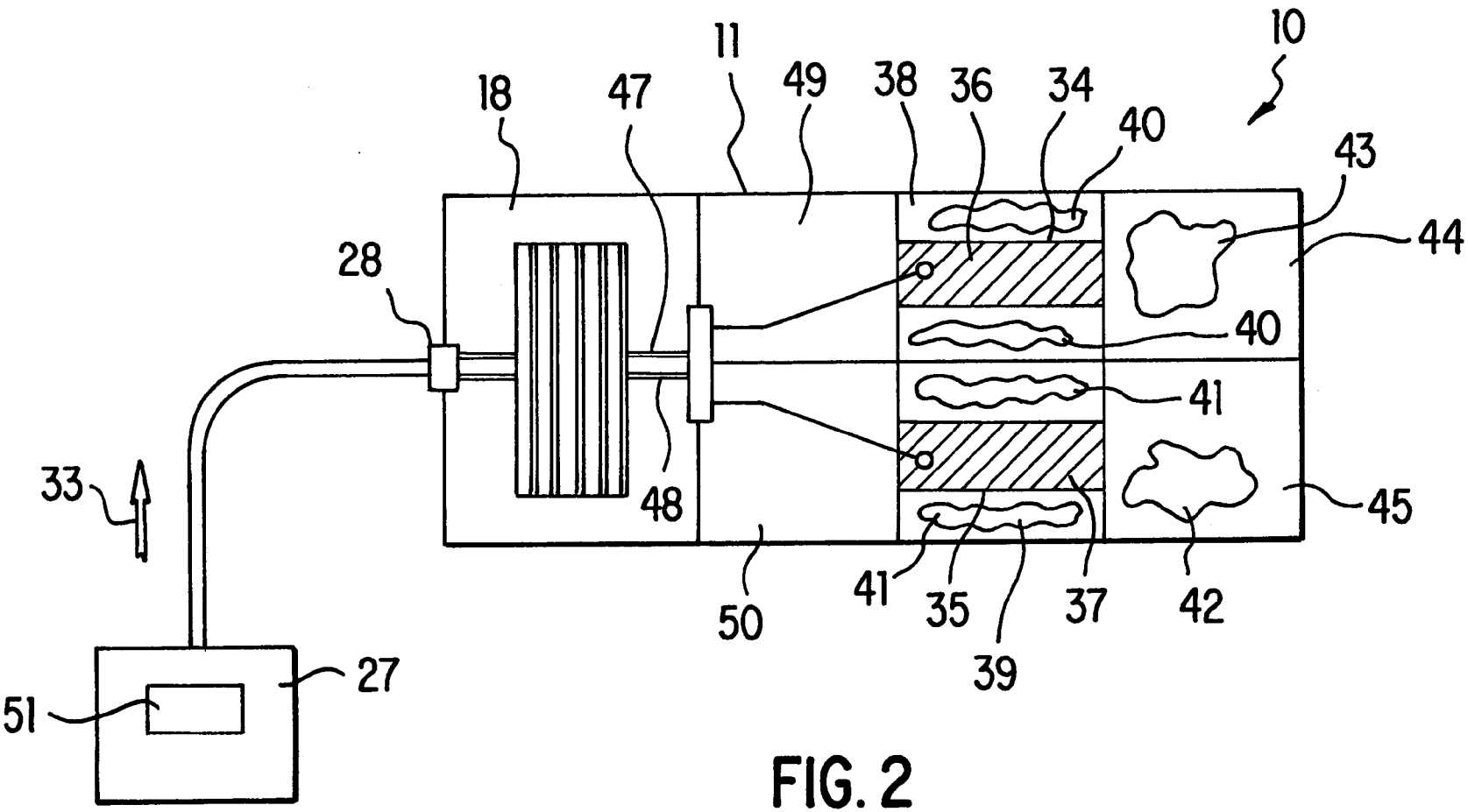
FIG. 2 is a schematic diagram of a non-fragmenting grenade of the present invention with two laser-input ports.

In an alternative embodiment of the grenade 10, shown in FIG. 2, a non-fragmenting grenade with two laser input ports using non-lethal pyrotechnic loads is provided which includes the canister 11, having two primary sections 34 and 35 receiving two energetic materials 36 and 37. Two propellant sections 38 and 39 are positioned which surround the respective primary sections 34 and 35. Each of the propellant sections 38 and 39 receives a respective propellant charge material 40 and 41. Two non-lethal pyrotechnic loads, light load 42 and sound load 43 may be received within the load sections 44 and 45, respectively.

The radiation pulses generated at the laser source 27, which may be in a form of a laser gun, are transported to the primary sections 34 and 35 through two fiber-optic cables 47 and 48 extending through the two laser input ports 49 and 50. An electronic control sub-system 51 of the laser gun 27 controls the laser gun 27 in a manner which allows the radiation pulses to be transported to the primary sections 34 and 35 either independently or simultaneously. This in turn ignites propellant sections 38 and 39 in the same fashion, i.e., independently or simultaneously, and in turn, actuate the light load 42 or sound load 43, once again independently or simultaneously. Thus, the fiber-optic cables 47 and 48 in conjunction with the programmable and/or controllable laser outputs produce a "smart" grenade 10.

Similarly to the embodiment shown in FIG. 1, the cable compartment 18 accommodates a wound fiber-optic cable which unwinds and freely releases from the cable compartment 18 through the cable port 28 during travel of the grenade 10 to the target.

Figure 3:
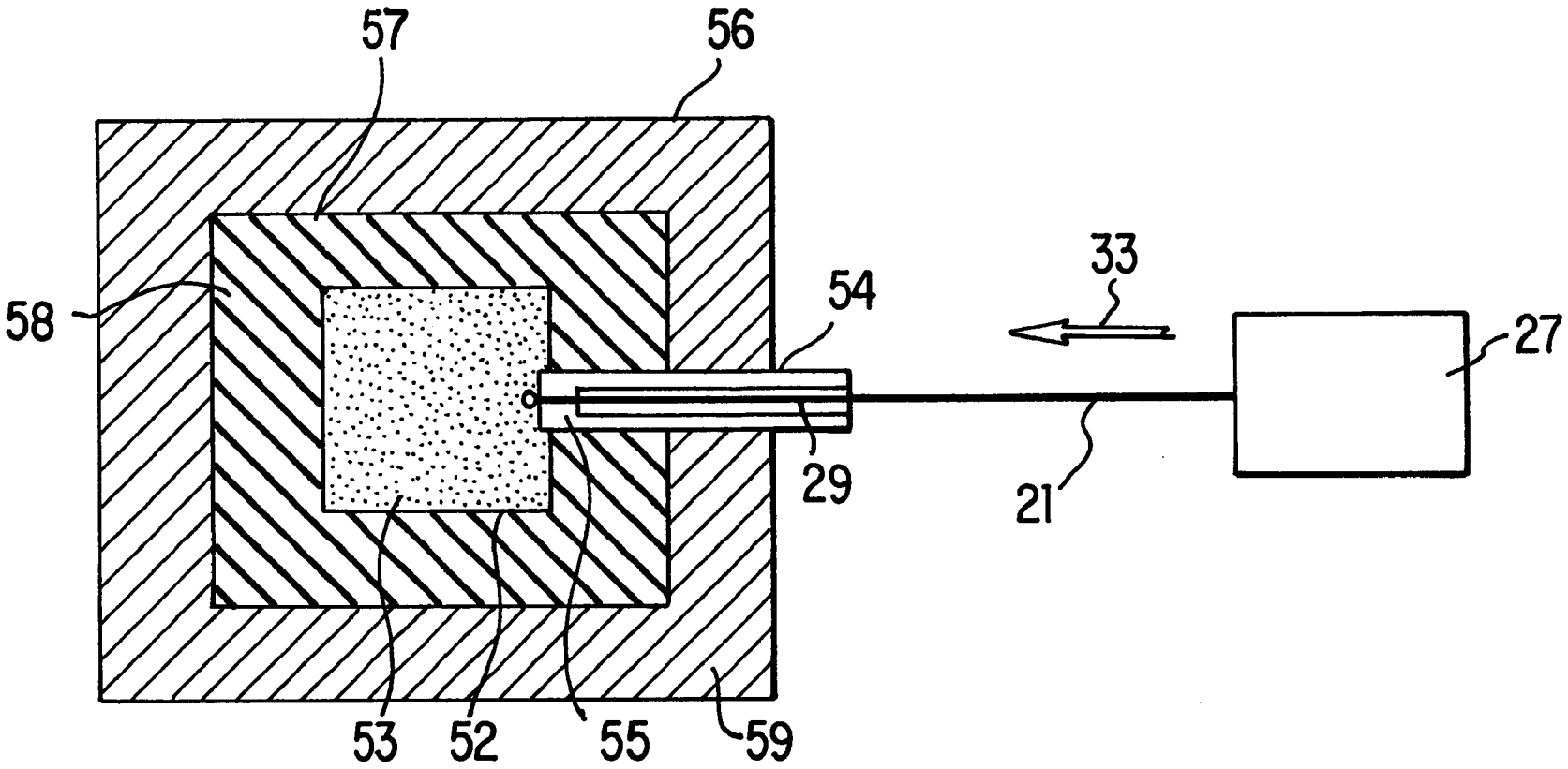
FIG. 3 is a schematic diagram of a fragmenting grenade of the present invention.

FIG. 3 shows another implementation of the grenade 10 of the present invention which is a fragmenting grenade embodiment having the primary section 52 receiving the energetic material 53 which is ignited by the laser pulses transported to the primary section 52 by the fiber-optic cable 21. The end 29 of the cable 21 enters the grenade via the cable entrance 54 and is arranged in intimate contact with the energetic material 53 via the laser port 55.

The preferred geometry for the lethal fragmented grenade is spherical with the primary section 52 being the innermost section. The fragmenting load section 56 is generally the outermost section, and the propellant section 57 is sandwiched between the primary section 52 and the fragmenting load section 56. Not shown in FIG. 3 is the compartment that is used to store the desired length of the fiber-optic cable 21. This compartment may be an integral part of the grenade 10, as is shown in FIGS. 1 and 2, or may be integral with the laser gun system 27.

In the grenade 10 shown in FIG. 3, upon ignition of the energetic material 53 by radiation pulses delivered from the laser gun 27, the propelling charge explosive train and the burning process of the propellant material 58 in the propellant section 57 actuate the lethal fragmenting load 59 which is located in the fragmenting load section 56. The fragmenting load (shrapnel) is fused inside the section 56. The shrapnel load may be composed of metal or non-metal (composite, rubber, plastic, etc.) balls or other particulates which are fused within the grenade 10 and explode when detonated at the target. The shrapnel type, size, quantity, and effective range is made consistent with the lethal or non-lethal desired effect.

Figure 4:
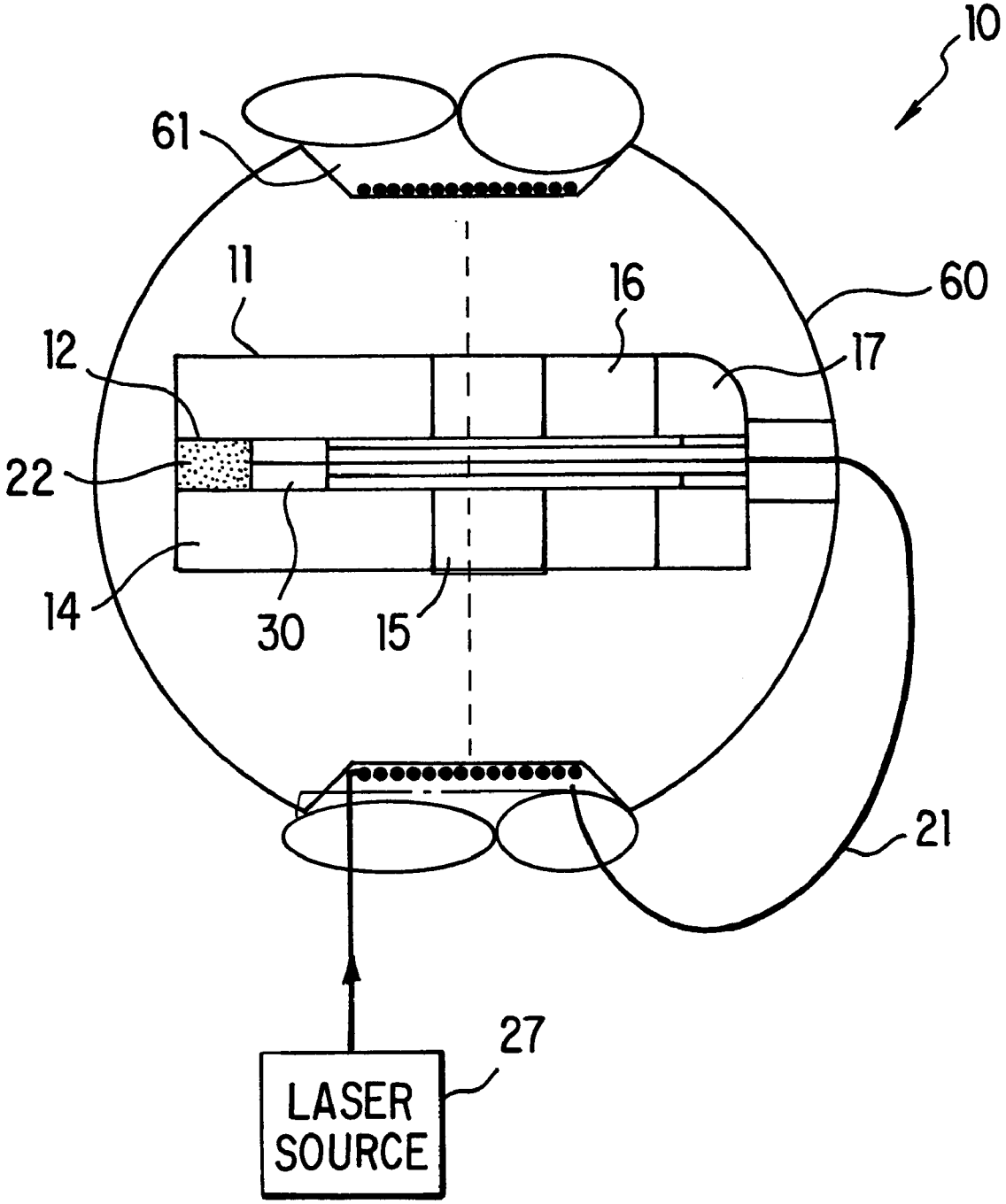
FIG. 4 is a schematic diagram of a non-fragmenting grenade of the present invention of a spherical/oval geometry with a single laser input port.

Shown in FIG. 4 is still another embodiment of the grenade of the present invention in a non-fragmenting implementation thereof. The grenade 10 of FIG. 4 has a spherical/oval geometry with a single laser input port 30 and with the layout of the internal sub-systems within the canister 11 similar to that one shown in FIG. 1. A shell 60 of a spherical/oval shape is formed from molded polyurethane foam that surrounds all the internal compartments to form a lightweight and highly durable package with respect to environmental conditions. The shell 60 has a notch 61 extending around the periphery of the shell in order that the fiber optic cable 21 is easily wound around the shell 60 and extends throughout and within the notch 61.

Figure 5:
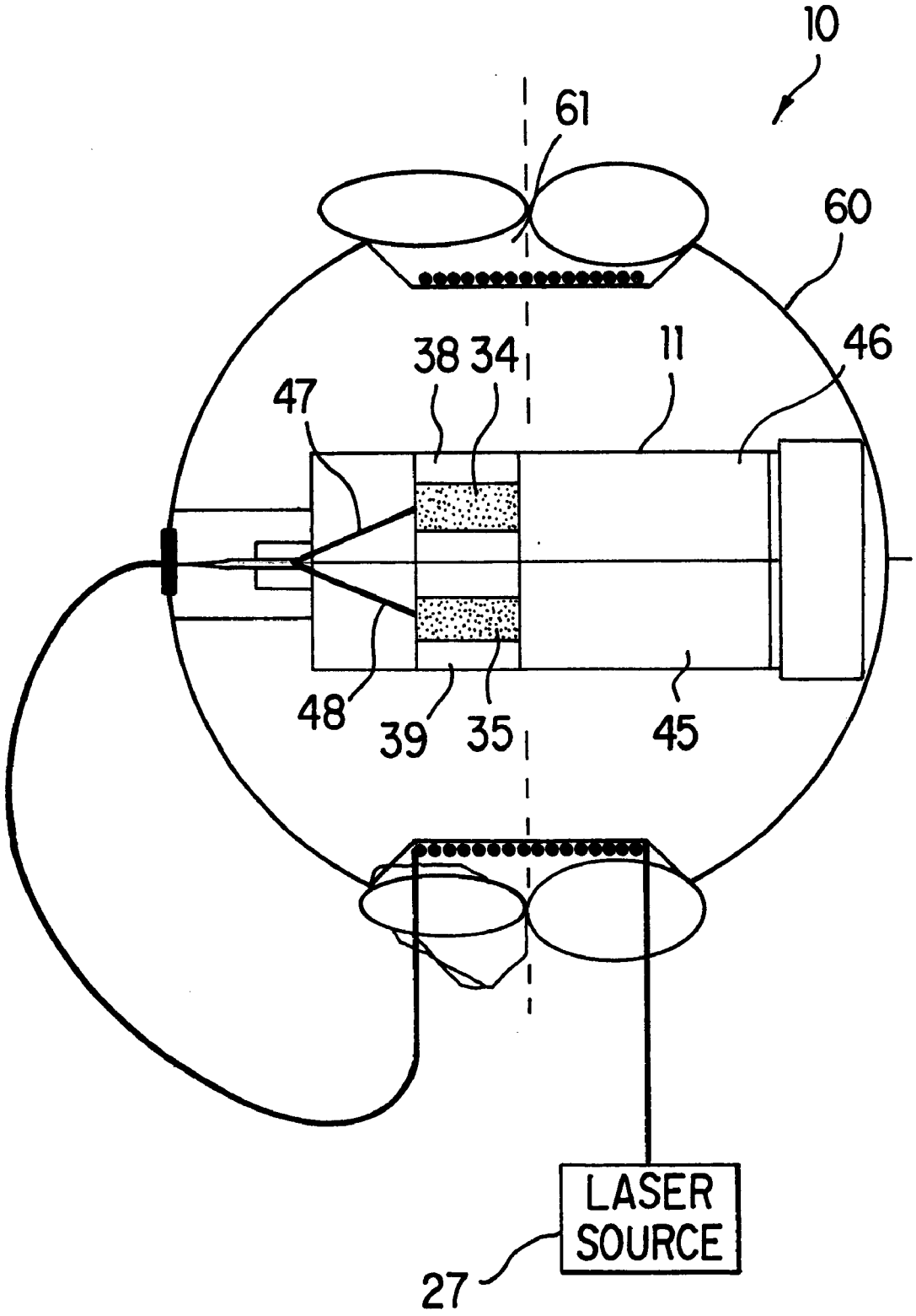
FIG. 5 is a schematic diagram of the non-fragmenting grenade of the present invention of a spherical/oval geometry with multiple laser input ports.

In the alternative embodiment thereof shown in FIG. 5, the grenade 10 similar to that shown in FIG. 2 is received within the shell 60 similar to FIG. 4 having the notch 61 where the fiber optic cables 47 and 48 of the grenade 10 is wound around shell 60.

Figure 6:
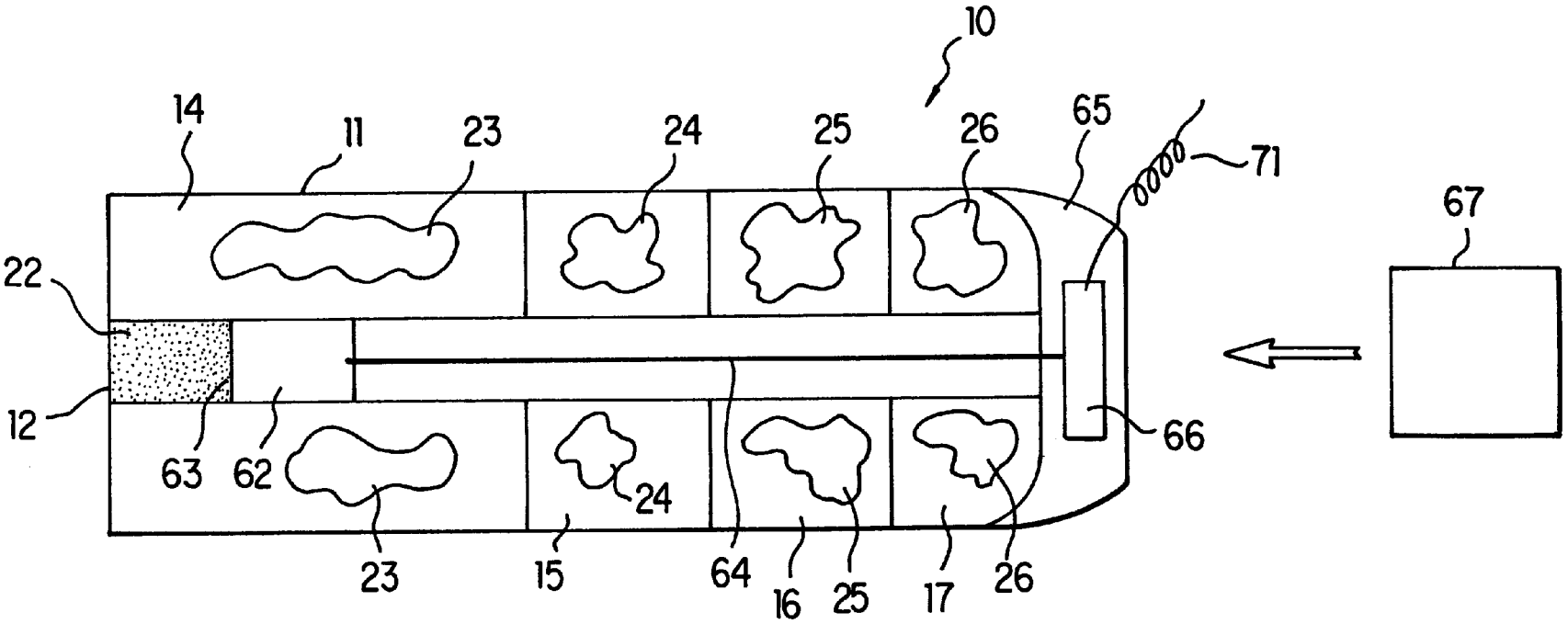
FIG. 6 is a schematic diagram of the non-fragmenting grenade of the present invention with a laser diode array sub-system embedded within the grenade.

Shown in FIG. 6 is a schematic diagram of the non-fragmenting grenade 10 with an IR, UV or visible laser source embedded in the canister 11. As can be seen, the grenade 10 of FIG. 6 includes a canister 11 having a primary section 12, a propellant section 14, and load sections 15–17. The energetic material 22 is received in the primary section 12, the propellant charge material 23 is received in the propellant section 14, and a light agent, sound agent, and/or malodorous/dye agent is received respectively in the load sections 15, 16, and 17. The design of the grenade 10 of FIG. 6 is similar to the design of the grenade shown in FIG. 1. However, the laser source 62 is embedded in the grenade. The laser source is preferably a miniaturized laser diode array sub-system which upon actuation generates radiation pulses delivered to the energetic material 22 within the primary section 12 through the laser output port 63.

An electrical cable 64 extends within the canister 11 between a compartment 65 in which a receiver/converter 66 is positioned to the laser source 62. The grenade 10 of FIG. 6 is controlled by a coded microwave/RF signal of approximately 100 MHz frequency transmitted from a source 67 preferably using a spread-spectrum technique to an antenna 71 and hence to receiver/converter 66. The antenna 71 can be of a printed-circuit type that is integral with the canister housing 11 or a omni-directional type antenna capable of receiving a coded/microwave RF signal from any direction. In this format the canister material is not limited to a transparent microwave/RF material. The microwave receiver 66 receives the coded microwave/RF signal, and converts the incoming signal into an electrical signal which travels along the electrical cable 64 to the laser source 62.

The laser source, thus actuated, generates a radiation pulse of infrared or ultraviolet energy which is delivered to the energetic material 22 within the primary section 12 and ignites the energetic material 22. This initiates the propelling charge explosive train, and the burning process of the propellant charge material 23 which is located in the propellant section 14. The burning propellant in turn actuates the load materials 24–26 in the load sections 15–17.

The canister 11 in the embodiment of the grenade 10 shown in FIG. 6 is composed of a material that is transparent and has low-loss to microwave/RF energy, such as styrofoam. In this format, the antenna 71 may be located inside the canister housing 11. A coded signal using a digital spread spectrum techniques is the preferred technique over analog coded signals since it has an improved signal-to-noise ratio and it is more secure and jam resistant.

Figure 7:
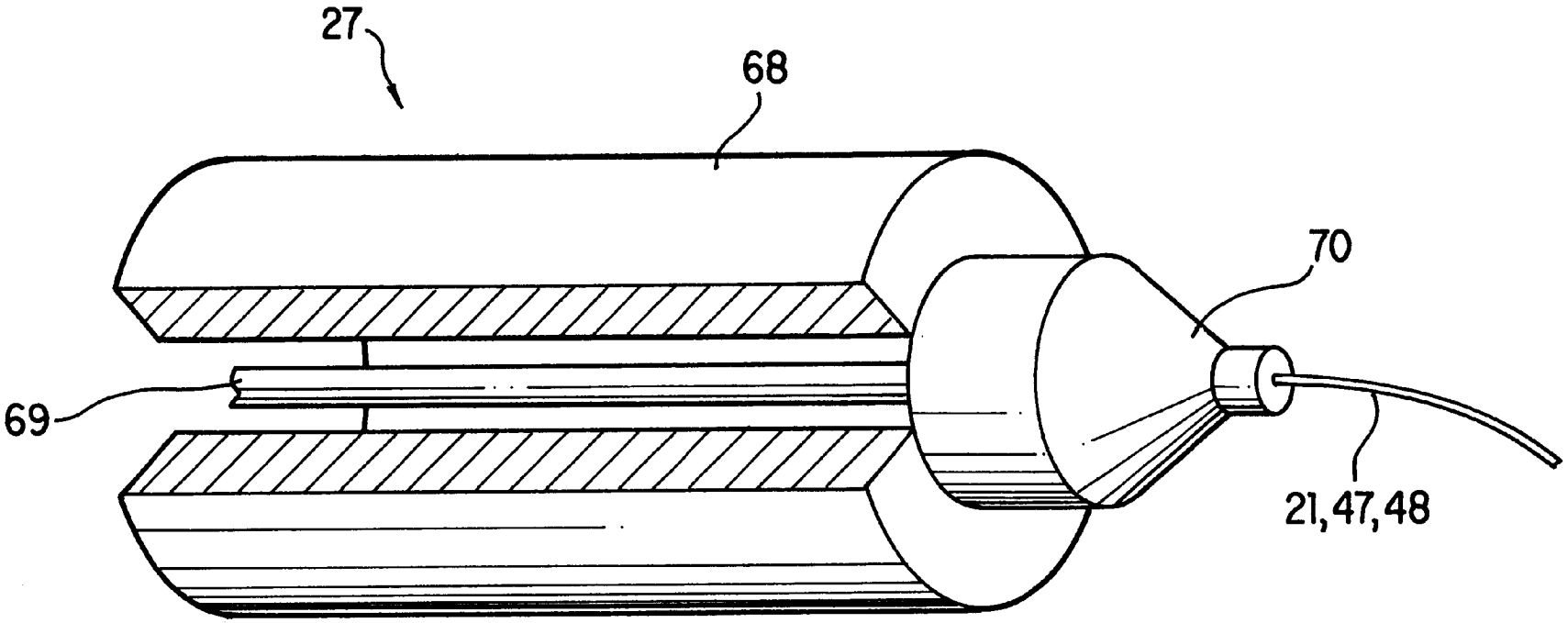
FIG. 7 shows a partially sectioned laser gun with a fiber optic cable coupled thereto used in the grenade of the present invention.

Shown in FIG. 7 is a laser gun used as a laser source in several embodiments of the grenade 10 of the present invention and a fiber optic cable 21, or 47, 48 coupled to the laser gun 68. The laser gun 68 is a miniaturized laser source that uses an optical pumped laser rod 69 that is about 10–15 cm long. The laser gun 68 generally weighs less than one pound, has several joules of energy in millisecond wide pulses, with the pulses produced being single or repetitive. The fiber optic cables 21 or 47, 48 are connected to the output section 70 of the laser gun 68. The core diameter of the optical cable is 100–200 microns and the maximum outer diameter of the optical cable is less than 1 millimeter. Several hundred millijoules of energy are generally sufficient to initiate a secondary explosive of the grenade 10.

As described, this invention has wide military applications as non-lethal (diversionary charge) or lethal grenades and agile target effect grenades for crowd and riot control. The grenade 10 of the present invention in all described implementations thereof provides attractive features of tunability, user and environmental safety, cumulative target effects, multiple loads, improved performance and compactness.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A laser activated grenade, comprising:

a controllable laser source activated at user-selected times to generate radiation pulses upon activation of said laser source;

at least one energetic material;

coupling means operatively connecting said laser source to said at least one energetic material for delivery of said radiation pulses to said at least one energetic material for igniting said at least one energetic material, at least one propellant charge material positioned in operational contact with said at least one energetic material for triggering a propellant explosive train upon said energetic material ignition;

at least one load material responsive to said radiation pulses generated at said laser source for producing a predetermined target effect substantially at said user-selected times, wherein said at least one load material is disposed in operational contact with said at least one propellant charge material for producing said predetermined target effect upon said propellant explosive train being triggered;

a canister having a first end and a second end and further having side walls enveloping an interior compartment of said grenade, said interior compartment including:

(a) at least one primary section receiving said at least one energetic material therein, (b) at least one propellant section positioned in direct contact with said at least one primary section for receiving said at least one propellant charge material therein, (c) at least one load section positioned in proximity to said at least one propellant section and receiving said at least one load material therein, wherein said laser source is positioned external said canister, said coupling means includes at least one fiber optic cable coupled between said laser source and said at least one energetic material within said at least one primary section; and a cable storage compartment within said canister, said fiber optic cable being received within said cable storage for release therefrom to a predetermined length.

2. A laser activated grenade, comprising:

a controllable laser source activated at user-selected times to generate radiation pulses upon activation of said laser source;

at least one energetic material;

coupling means operatively connecting said laser source to said at least one energetic material for delivery of said radiation pulses to said at least one energetic material for igniting said at least one energetic material;

at least one propellant charge material positioned in operational contact with said at least one energetic material for triggering a propellant explosive train upon said energetic material ignition;

at least one load material responsive to said radiation pulses generated at said laser source for producing a predetermined target effect substantially at said user-selected times, wherein said at least one load material is disposed in operational contact with said at least one propellant charge material for producing said predetermined target effect upon said propellant explosive train being triggered;

a canister having a first end and a second end and further having side walls enveloping an interior compartment of said grenade, said interior compartment including:

(a) at least one primary section receiving said at least one energetic material therein, (b) at least one propellant section positioned in direct contact with said at least one primary section for receiving said at least one propellant charge material therein, (c) at least one load section positioned in proximity to said at least one propellant section and receiving said at least one load material therein.

wherein said laser source is positioned external said canister, said coupling means includes at least one fiber optic cable coupled between said laser source and said at least one energetic material within said at least one primary section; and a shell of substantially spherical/oval geometry for receiving said canister therein, said shell having a notch formed therein extending around a peripheral thereof said at least one fiber optic cable being wound around said shell and extending within said notch.

3. The laser activated grenade as recited in claim 2 wherein said shell is formed of polyurethane.

4. A laser activated grenade, comprising:

a controllable laser source activated at user-selected times to generate radiation pulses upon activation of said laser source; and at least one load material responsive to said radiation pulses generated at said laser source for producing a predetermined target effect simultaneously at said user-selected times, wherein said laser source includes a laser gun.

5. The laser activated grenade as recited in claim 4, including:

at least one energetic material;

coupling means operatively connecting said laser source to said at least one energetic material for delivery of said radiation pulses to said at least one energetic material for igniting said at least one energetic material, and at least one propellant charge material positioned in operational contact with said at least one energetic material for triggering a propellant explosive train upon said energetic material ignition;

said at least one load material being disposed in operational contact with said at least one propellant charge material for producing said predetermined target effect upon said propellant explosive train being triggered.

6. The laser activated grenade as recited in claim 4 wherein said radiation pulses include infrared radiation.

7. The laser activated grenade as recited in claim 4 wherein said radiation pulses include ultraviolet radiation.

8. The laser activated grenade as recited in claim 4 wherein said radiation pulses include visible radiation.

9. The laser activated grenade as recited in claim 5 including:

a canister having a first end and a second end and further having sidewalls enveloping an interior compartment of said grenade;

said interior compartment including:

at least one primary section receiving said at least one energetic material therein;

at least one propellant section positioned in direct contact with said at least one primary section for receiving said at least one propellant charge material therein; and, at least one load section positioned in proximity to said at least one propellant section and receiving said at least one load material therein.

10. The laser activated grenade as recited in claim 9 wherein said laser source is positioned external said canister, said coupling means including at least one fiber optic cable coupled between said laser source and said at least one energetic material within said at least one primary section.

11. The laser activated grenade as recited in claim 10 further including a cable storage compartment within said canister, said fiber optic cable being received within said cable storage for release therefrom to a predetermined length.

12. The laser activated grenade as recited in claim 10 further comprising:

a plurality of said primary sections, each of said primary sections receiving a respective energetic material therein, a plurality of said propellant sections, each of said propellant sections receiving a respective propellant charge material and positioned in contact with a respective one of said plurality of said primary sections, a plurality of said load sections, each of said load sections receiving a respective load material, each of said plurality of said load sections being positioned in contact with a respective one of said plurality of said propellant sections, and a plurality of fiber optic cables, each of said fiber optic cables extending between said laser source and said respective energetic material in one of said plurality of said primary sections;

whereby each respective load material produces a predetermined target effect responsive to said radiation pulses delivered from said laser source to said grenade through a respective one of said plurality of said fiber optic cables.

13. The laser activated grenade as recited in claim 12 further comprising a control sub-system operatively coupled to said laser source, said control sub-system for selectively controlling transmission of said radiation pulses through each of said fiber optic cables.

14. The laser activated grenade as recited in claim 9 wherein said at least one primary section is surrounded by said at least one propellant section, and at least one propellant section is surrounded by said at least one load section, said load section receiving a fragmenting load material.

15. The laser activated grenade as recited in claim 9 wherein said laser source is positioned internal said canister, said laser source being controlled by a coded control signal received from a remote control source.

16. The laser activated grenade as recited in claim 15, further comprising an antenna and a receiver for receiving said coded control signal, a converter for converting said coded control signal into a laser actuating signal, and means for conveying said laser actuating signal to said laser source, wherein said receiver and said converter are positionally located within said canister.

17. The laser activated grenade as recited in claim 16, wherein said coded control signal includes a microwave/RF signal, wherein said antenna is of a printed-circuit type integral with said canister, and wherein said canister is formed of a transparent material having low-loss to microwave/RF radiation.

18. The laser activated grenade as recited in claim 16, wherein said antenna extends outside of said canister.

19. The laser activated grenade as recited in claim 5, wherein said at least one energetic material has a surface area irradiated by said radiation pulses through said coupling means;

said surface area dimensions being adjusted by varying relative disposition between said coupling means and said at least one energetic material.

20. The laser activated grenade as recited in claim 10, further including a shell of substantially spherical/oval geometry for receiving said canister therein, said shell having a notch formed therein extending around a peripheral thereof, said at least one fiber optic cable being wound around said shell and extending within said notch.

21. The laser activated grenade as recited in claim 20, wherein said shell is formed of polyurethane.

22. The laser activated grenade as recited in claim 4, wherein said laser source further includes a laser diode array sub-system.

* * * * *